United States Patent [19]

Gill

[11] Patent Number: 4,527,492

[45] Date of Patent: Jul. 9, 1985

[54] JIG FOR STITCHING FABRIC LAYERS IN A SEWING MACHINE

[75] Inventor: Peter R. Gill, Leeds, England

[73] Assignee: AMF Incorporated, White Plains, N.Y.

[21] Appl. No.: 590,318

[22] Filed: Mar. 16, 1984

[51] Int. Cl.[3] ..... D05B 21/00

[52] U.S. Cl. ..... 112/121.12

[58] Field of Search ..... 112/121.12, 121.11, 112/121.15, 104, 113

[56] References Cited

U.S. PATENT DOCUMENTS

| | | | |
|---|---|---|---|
| 688,961 | 12/1901 | McDonald | 112/121.12 |
| 1,251,627 | 1/1918 | McDonald | 112/121.12 |
| 1,385,538 | 7/1921 | Green | 112/121.12 |

FOREIGN PATENT DOCUMENTS

| | | | |
|---|---|---|---|
| 2355938 | 1/1978 | France | 112/121.12 |
| 1282893 | 7/1982 | United Kingdom | 112/121.12 |
| 2110256 | 6/1983 | United Kingdom | 112/121.12 |

*Primary Examiner*—H. Hampton Hunter

*Attorney, Agent, or Firm*—David Dougherty; Thomas J. Durling

[57] ABSTRACT

A jig for use in stitching together two layers of material on a stitching line defining a corner. The jig has a lower plate (1) having a slot (4) through which stitching may be effected, the slot including at least one corner. An upper plate cooperates with the lower plate and a fulling plate (3) is positioned between the lower and upper plates and has fulling means (6 to 8) on its upper surface for defining pleats in a fabric layer placed over the fulling means. At least one of the fulling means has an upstanding, pleat-forming member (11) which is positioned so that the pleat formed thereby extends towards the slot (4) at a line that intersects the slot at a location lying ahead of the associated corner (13).

4 Claims, 6 Drawing Figures

FIG.1
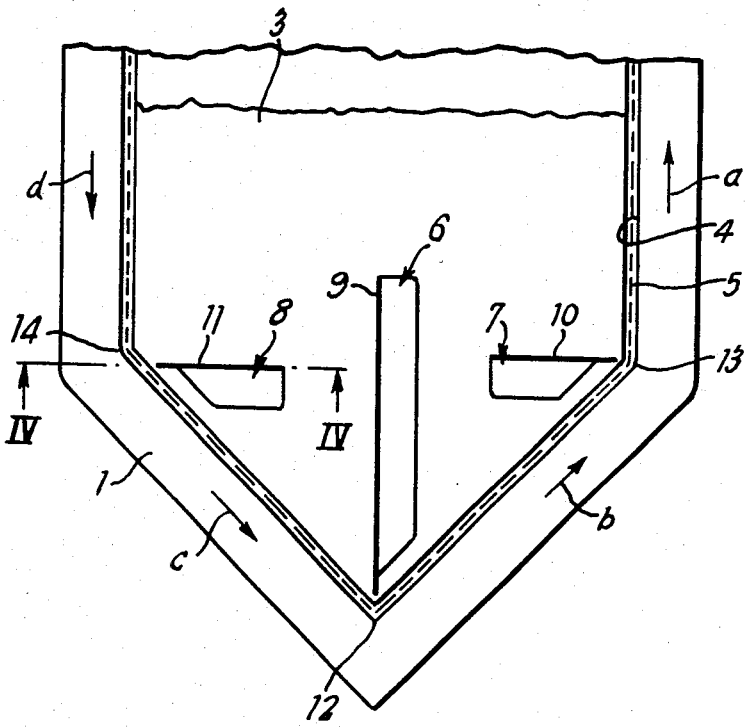
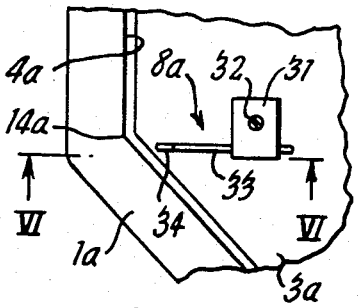
FIG.5
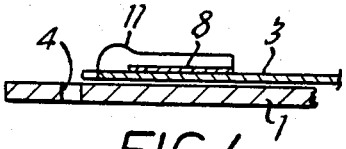
FIG.4
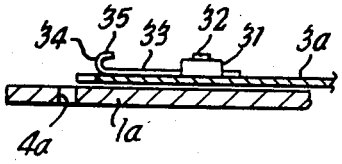
FIG.6

JIG FOR STITCHING FABRIC LAYERS IN A SEWING MACHINE

This invention relates to a jig for use in the stitching together of fabric layers in a sewing machine.

The use of such jigs is now commonplace, and a conventional jig construction comprises a lower plate having part engageable with guide means on the sewing machine and an upper plate, usually pivoted on the lower plate and capable of engaging the upper surface thereof. The layers of material to be stitched together are held between the upper and lower plates and as the jig is moved relative to the guide on the sewing machine the needle stitches through thc fabric layers where they overlie a slot in the lower plate so completing a required stitching line. Commonly, the slot forms a guide track engageable with the guide means. Most jigs incorporate fulling means between the lower and the upper plates, for introducing fulness into required areas of at least the uppermost fabric layer.

There are a number of fields where the stitching line to be effected includes a corner, and where an upper fabric layer is required to have fulness relative to a lower fabric layer in the region of the corner. One example is in a jig for production of neckties. In the production of such corners it is known from commonly assigned copending U.S. application Ser. No. 414,754 filed Sept. 3, 1982 to use a jig comprising a lower plate and an upper plate, with a fulling plate pivoted to the lower plate and lying between the upper and lower plates. A first layer of material is held between the fulling plate and the lower plate, and a second layer of material held between the fulling plate and the upper plate. Ribs project upwardly from the surface of the fulling plate in order to form pleats in the upper layer of material, which gives that layer fulness relative to the lower layer. The ribs extend along lines that intercept the guide track at corners of the guide track and when fabric is loaded into the jig there are thus formed upstanding pleats in the upper fabric layer, the pleats extending towards the guide track corners. As the jig is advanced through the sewing machine such pleats are deflected downwardly and are stitched to the fabric layers. In some instances it is found that after deflection of the pleat a sharp corner is defined on the stitched fabric but in other instances that corner takes on a round form which may not be acceptable in the article being produced. The invention seeks to overcome this problem.

According to the invention a jig for use in the stitching together of two layers of material along a stitching line that defines a corner, comprises a lower plate having a part engageable with guide means on the sewing machine and having a slot through which stitching may be effected, the slot including a corner and defining the stitching line, an upper plate cooperable with the lower plate and fulling means between the lower and upper plates, the fulling means having an upstanding member for defining a pleat in a fabric layer placed over the fulling means, the member being positioned so that the pleat extends towards the slot along a line that intersects the slot at a location lying ahead of the corner of the slot.

Surprisingly, by positioning the upstanding member so that the pleat extends towards the slot along a line that intersects the slot at a location ahead of the corner the problem of producing a curved corner disappears, and a sharp point is achieved at the corner. The optimum positioning for the upstanding member is such that as the pleat is turned down at the corner the tip of the upper edge of the pleat is folded to lie substantially in the region of the point. It is not necessary to include an upstanding member located as stated in the invention at every corner defined by the slot and the location may only be used at those corners which are known to cause problems. Thus, at certain corners the fulling means may be such that a pleat is formed which will intersect the corner. At other corners the fulling means may be such that the formed pleat intersects the slot at a location following the corner of the slot.

In one preferred embodiment the upstanding member is a blade or rib extending towards the slot to intersect the slot ahead of the corner. In another embodiment the upstanding member is a pin positioned to create the required seam alignment. Other configurations of upstanding member are also possible.

In order that the invention may be better understood specific embodiments of jigs in accordance therewith will now be described in more detail, by way of example only, with reference to the accompanying drawings in which:

FIG. 1 is a partial plan view of a lower plate and fulling plate of a first embodiment of jig;

FIG. 4 is a section on the line IV—IV of FIG. 1; and

FIGS. 5 and 6 are respectively a plan view and section on line VI—VI of part of a second embodiment of jig.

Figure 2:
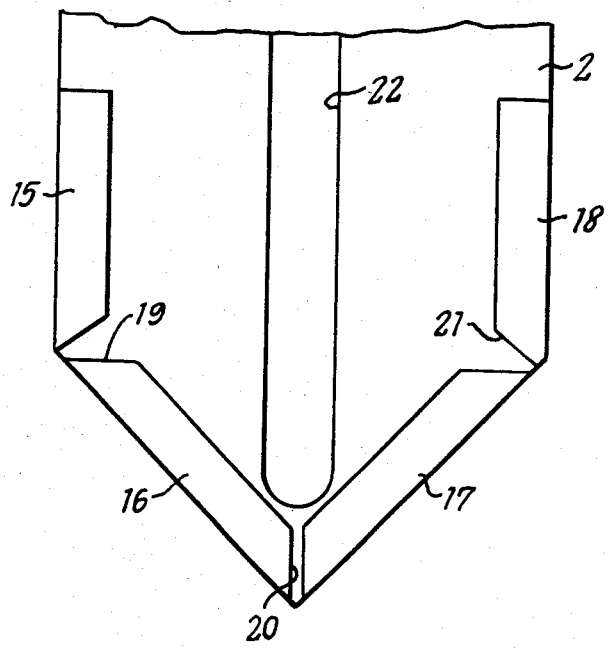
FIG. 2 is an underneath plan view of an upper plate of the jig of FIG. 1.
Figure 3:
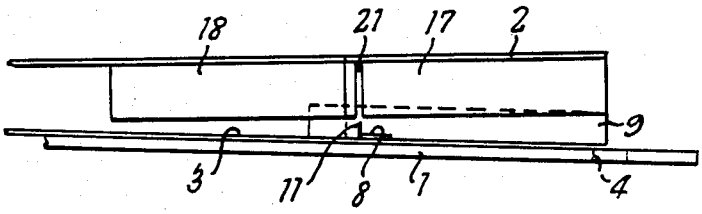
FIG. 3 is a side elevation of the jig of FIG. 1.

As seen in FIGS. 1 to 4 a jig for use in the stitching together of a face fabric and lining fabric for a necktie comprises a lower plate 1, an upper plate 2 and a fulling plate 3 lying between the upper and lower plates. In well known manner, both the fulling plate and the upper plate are pivotally mounted on the lower plate about coaxial hinge assemblies not shown in the drawings. The lower plate has a stitching slot 4 formed therein, the slot also forming a guide track which is engageable with guide means on the base plate of the sewing machine. The sewing machine will usually also incorporate means for driving the jig relative to the needle so that the needle can follow a stitching line 5 as it passes through the stitching slot. Such arrangements are well known to those skilled in the art. The upper face of the fulling plate 3 has fulling means 6 to 8 secured thereto, each fulling means having a blade or rib 9 to 11 respectively, extending upwardly from the fulling plate, and shaped to give the required fulling effect. The stitching slot defines three corners 12 to 14 and each rib terminates in the vicinity of a respective one of those corners.

The lower surface of the top plate 2 has secured thereto a plurality of blocks 15 to 18 defining spaces 19 to 21 therebetween. When the top plate 2 is lowered onto the fulling plate, part of the rib 9 is received in the space 20, part of the rib 10 is received in the space 19 and part of the rib 11 is received in the space 21. The top plate also has a central opening 22 through which the remainder of the rib 9 may be observed.

From FIG. 1 it will be seen that the rib 9 extends towards the stitching slot along a line that intersects the slot at the corner 12 of the slot. Similarly, the rib 10 extends towards the slot along a line that intersects the slot at the corner 13. However, the rib 11 extends along a line that intersects the slot at a location lying ahead of the corner 14 of the slot, this rib being thus positioned in accordance with the invention.

In use, the three plates of the jig are opened. A layer of lining fabric is placed over the lower plate, the lining fabric having been roughly cut to shape so that it overlies the whole of the stitching slot. The fulling plate is then lowered to hold the lining fabric between the fulling plate and the lower plate. A layer of face fabric is placed over the fulling plate, the face fabric again having been roughly cut to shape so that it will overlie the whole of the stitching slot. The upper plate is then lowered onto the fulling plate and as it is so lowered, the cooperation between the blocks 15 to 18 and the ribs 9 to 11 causes the face fabric to be pleated along the line of the ribs, so introducing fulness into the face fabric in the corner regions. Fulness along the line of the rib 9 may desirably be completed before fulling along the lines of the ribs 10, 11 is commenced, as described in GB-A No. 2,110,256. Each pleat extends unsupported from the end of the rib to the edge of the face fabric at a corner region thereof. With the guide member on the sewing machine engaged in the stitching slot or guide track of the jig, the loaded jig is then moved relative to the needle as the sewing machine effects the stitching operation. The jig is first moved to follow the direction of the arrow a until the corner region 13 reaches the needle, whereupon the jig is turned through the angle of the corner and relative movement then continues as indicated by the arrow b. At the corner 13 it is found that the presser foot of the sewing machine engages the upstanding part of the pleat in the face fabric, folds this down to lie on the face fabric and stitches it to the face and lining fabrics. The fold appears to be automatically effected in such a way that the fabric exhibits a sharp point at the corner. After movement in direction b the corner region 12 reaches the needle, and stitching in this region may be effected as described in GB-A No. 2,110,256 to ensure that the pleat extending from the rib 9 remains upstanding and is not stitched to any other part of the fabric. At this corner, the jig is turned through the angle of the corner and sewing then recommences with the jig moving relative to the needle as indicated by the arrow c.

Before the prsser foot reaches the corner 14 it contacts the pleat of the face fabric that extends from the rib 11, folding this down onto the remainder of the face fabric. The needle then stitches the pleat to the remainder of the fabric in the folded down position, the jig is turned through the angle of the corner and stitching is then completed by movement of the jig as indicated by the arrow d.

It has been found that if the rib 11 were to follow a line that intersects the stitching slot at the corners 14, in the same way as the rib 10 follows a line that intersects the slot at the corner 13 then the effect of stitching at the corner 14 would be to form a rounded edge, rather than a clearly defined point. Positioning of the rib 11 so that the pleat is formed in advance of the corner overcomes this problem and a clearly defined point results. It has been determined that the optimum corner shape is obtained if the stitching leaves the pleat at a point coinciding with the point at which the jig is actually turned about the needle to change from direction c to direction d. The optimum distance by which the rib 11 is spaced ahead of the corner thus depends on the height of the pleat that is formed by the rib, a higher pleat requiring a greater rib to corner distance and vice versa.

In the jig described, the rib 10 intersects the stitching slot at the corner 13, but if necessary it may be positioned to intersect the slot either ahead of, or following, the corner.

FIGS. 5 and 6 show part of a second embodiment of jig, similar in many respects to that of FIG. 1, and in which corresponding parts are identified by the same reference numeral as in FIG. 1, with the suffix a. The jig comprises a lower plate 1*a* having a stitching slot 4*a*, an upper plate and a fulling plate 3*a* carrying a central fulling blade identical to that shown in FIG. 1 and two side fulling means differing from the side fulling means shown in FIG. 1. Side fulling means 8*a* is illustrated in FIG. 5, that at the other side of the jig being similar. Each side fulling means comprises a holder 31 adjustably secured to the lower plate 1*a* by a screw 32 engaging a tapped hole. The holder clamps a rod 33 in position on the lower plate, the rod terminating at its outer end in an upstanding pin 34 having an inturned end 35 to prevent the pin from penetrating fabric laid thereover. The pin 34 of fulling means 8*a* is positioned so that a pleat will be formed in the fabric to extend towards the stitching slot and to intersect that slot ahead of the corner 14*a*. The corresponding pin of the fulling means at the other side may be positioned to form a pleat that intersects the stitching slot either at, ahead of, or following, the corresponding corner, as required. Stitching may be effected using this jig in a manner analagous to that already described.

For convenience, the foregoing description has referred to the pleats from ribs 10 and 11 being deflected by the presser foot of the sewing machine. In practice, the presser foot will generally rest on the upper surface of the upper plate 2, and a deflector element not shown in the drawings will be mounted on the machine ahead of the needle in order to contact and deflect the pleats.

It will be understood that the invention is not limited to the tipping of neckties, and may find application in other fields where it is necessary to define a corner of a similar nature. The particular form of the lower plate, upper plate, fulling plate and fulling means shown in the drawings may be changed as required, and positioning of a pleat-forming rib in advance of its associated corner may be effected at any corner of the guide track.

I claim:

1. A jig for use in the stitching together of two layers of material along a stitching line that defines a corner, the jig comprising a lower plate having a part engageable with guide means on the sewing machine and having a slot through which stitching may be effected, the slot including a corner and defining the stitching line, an upper plate cooperable with the lower plate and fulling means between the lower and upper plates, the fulling means having an upstanding member for defining a pleat in a fabric layer placed over the fulling means, the member being positioned so that the pleat extends towards the slot along a line that intersects the slot at a location lying ahead of the corner of the slot.

2. A jig as claimed in claim 1 in which the stitching line defines a plurality of corners each having an associated fulling means, one only of said fulling means having an upstanding member positioned as defined in claim 1.

3. A jig as claimed in claim 1 in which the upstanding member is a blade extending towards the slot to intersect the slot ahead of the corner.

4. A jig as claimed in claim 1 in which the upstanding member is a pin positioned to create the required seam alignment.

* * * * *